US006173754B1

(12) United States Patent
DeBlock

(10) Patent No.: US 6,173,754 B1
(45) Date of Patent: Jan. 16, 2001

(54) WINDOW COVERING SYSTEM

(75) Inventor: David A. DeBlock, Holland, MI (US)

(73) Assignee: ODL Incorporated, Zeeland, MI (US)

( * ) Notice: Under 35 U.S.C. 154(b), the term of this patent shall be extended for 0 days.

(21) Appl. No.: 09/373,153

(22) Filed: Aug. 12, 1999

(51) Int. Cl.[7] ..... A47H 1/00

(52) U.S. Cl. ..... 160/98; 160/23.1; 160/24; 160/382; 24/295; 411/508; 411/913

(58) Field of Search ..... 160/23.1, 24, 98, 160/103, 350, 351, 382, 383, 399, 404, 903; 24/295; 403/402; 52/511, 715, 512; 411/508, 509, 913

(56) References Cited

U.S. PATENT DOCUMENTS 2,579,788 * 12/1951 Burns ..... 160/23.1 X
3,038,571 * 6/1962 Clements ..... 52/512
3,060,988 * 10/1962 Munse ..... 411/913 X
3,071,827 * 1/1963 Van Buren, Jr. ..... 52/511
3,088,560 * 5/1963 Preuss ..... 52/511 X
3,719,220 * 3/1973 Small ..... 160/23.1 X
3,811,370 * 5/1974 Boston, Jr. et al. ..... 160/26 X
3,881,676 * 5/1975 Reinwall ..... 403/407 X
4,074,491 * 2/1978 Bell et al. ..... 52/511 X
5,171,165 * 12/1992 Hwang ..... 411/913 X
5,297,891 * 3/1994 Rosa ..... 403/402
5,333,664 * 8/1994 Sirianni et al ..... 160/23.1
5,505,244 * 4/1996 Thumann ..... 160/23.1
5,595,416 * 1/1997 Horwill ..... 24/295 X
5,671,790 * 9/1997 Andersen et al. ..... 160/24
5,682,627 * 11/1997 Russell ..... 160/23.1 X

* cited by examiner

*Primary Examiner*—Bruce A. Lev
(74) *Attorney, Agent, or Firm*—Warner Norcross & Judd

(57) ABSTRACT

A doorlight shade assembly including a housing, a roller shade within the housing, and a pair of mounting clips. The clips each include a secured leg and a supporting leg perpendicular to each other. The secured leg of each clip fits between the door and a doorlight frame. The supporting leg of the clips receive and support the housing.

18 Claims, 5 Drawing Sheets

WINDOW COVERING SYSTEM

BACKGROUND OF INVENTION

The present invention relates to window coverings and more particularly to a window covering for doorlight within a door.

Exterior doors frequently have "doorlights" or windows, giving a feeling of openness by providing an outside view and allowing light in. The benefits of doorlights are offset by a privacy cost, of allowing people to see inside. To achieve privacy, roller shades, pleated shades, venetian blinds, and other window coverings are attached over these doorlights.

The majority of exterior doors containing these doorlights are made of thin sheet metal with a soft core. Prior art window coverings are attached to the door by screwing through the interior metal surface. Over time, the raising and lowering of these window coverings puts stress on the metal surface of the door. This stress can cause the metal to bulge outward or enlarge the screw hole to a point where the screws can no longer hold the window covering in place. If the window covering will not remain attached to the door, the homeowner has the option of replacing the door or drilling new holes in the door to reattach the window covering. Unfortunately, redrilling holes simply starts the process over again. Another drawback is that the two holes remain in the door if the window covering is removed.

SUMMARY OF THE INVENTION

The aforementioned problems are overcome in the present invention providing a window covering apparatus that allows the hanging of a window covering on a variety of surfaces, but especially allows the hanging of a window covering on a metal door without the need for any holes. More specifically, a clip rather than screws is used to support the window covering on the door. The clip fits behind the doorlight frame and is held tightly in place between the frame and the door—not by screws in the metal surface of the door.

The advantages are numerous. First, the clip fitting between the frame and the door allows for ease of installation with no holes having to be drilled. Second, without any screws being fastened to the surface of the door, the window covering maintains a firmer attachment to the door. Third, the door remains free of holes and aesthetically pleasing if the window covering is removed.

These and other objects, advantages and features of the invention will be more readily understood and appreciated by reference to the detailed description of the preferred embodiment and the drawings.

DESCRIPTION OF THE PREFERRED EMBODIMENT

Figure 1:
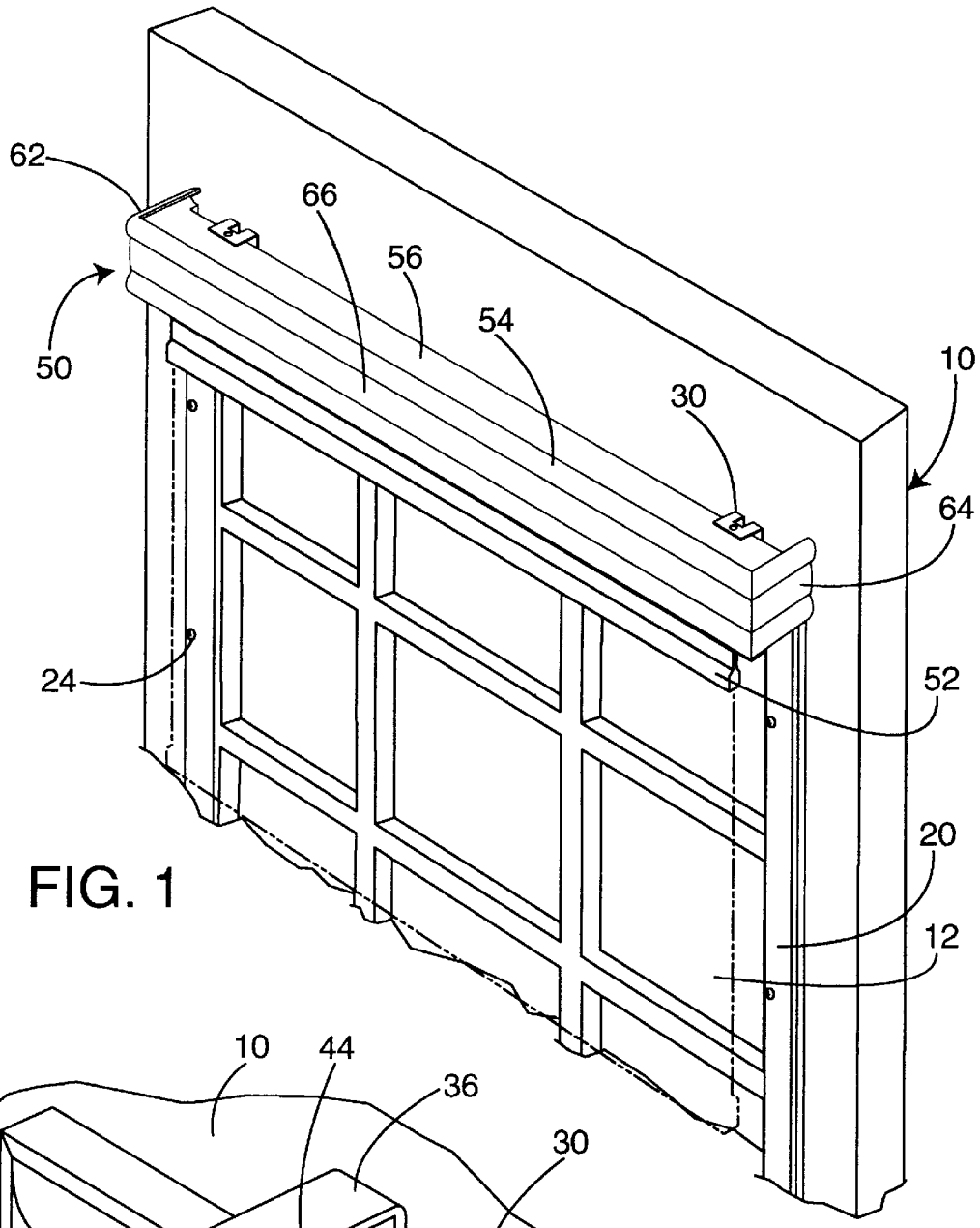
FIG. 1 is a perspective view of the window covering assembly mounted on a door.
Figure 2:
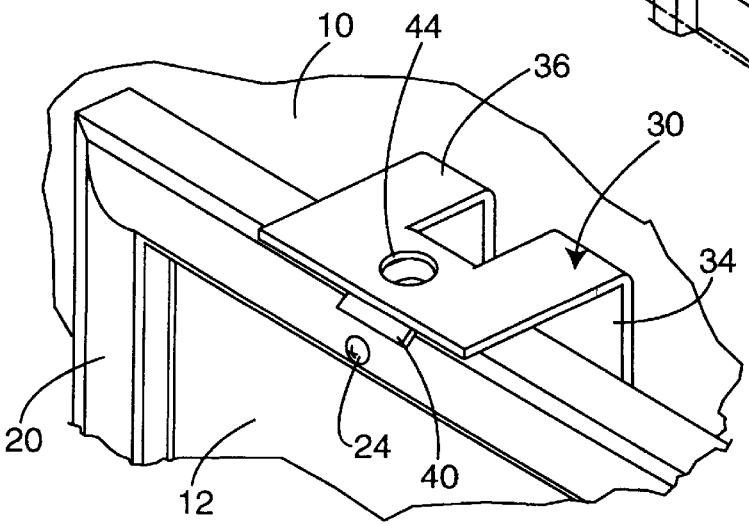
FIG. 2 is a perspective view of the clip fitted behind the doorlight frame.
Figure 3:
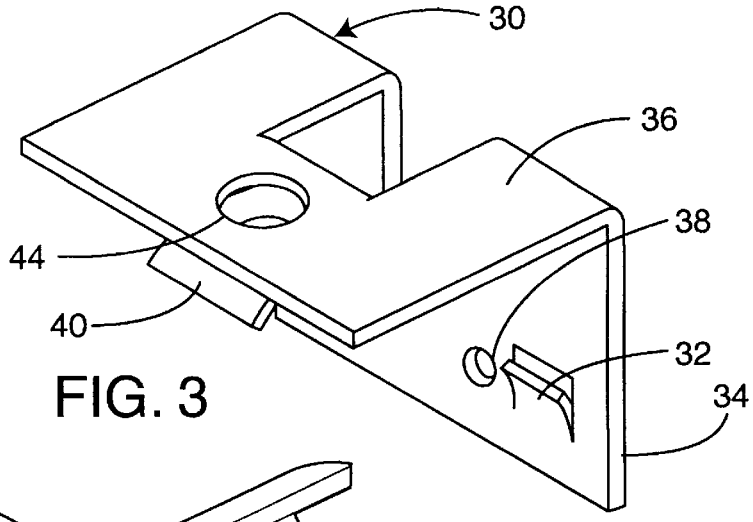
FIG. 3 is a perspective view of the clip.
Figure 4:
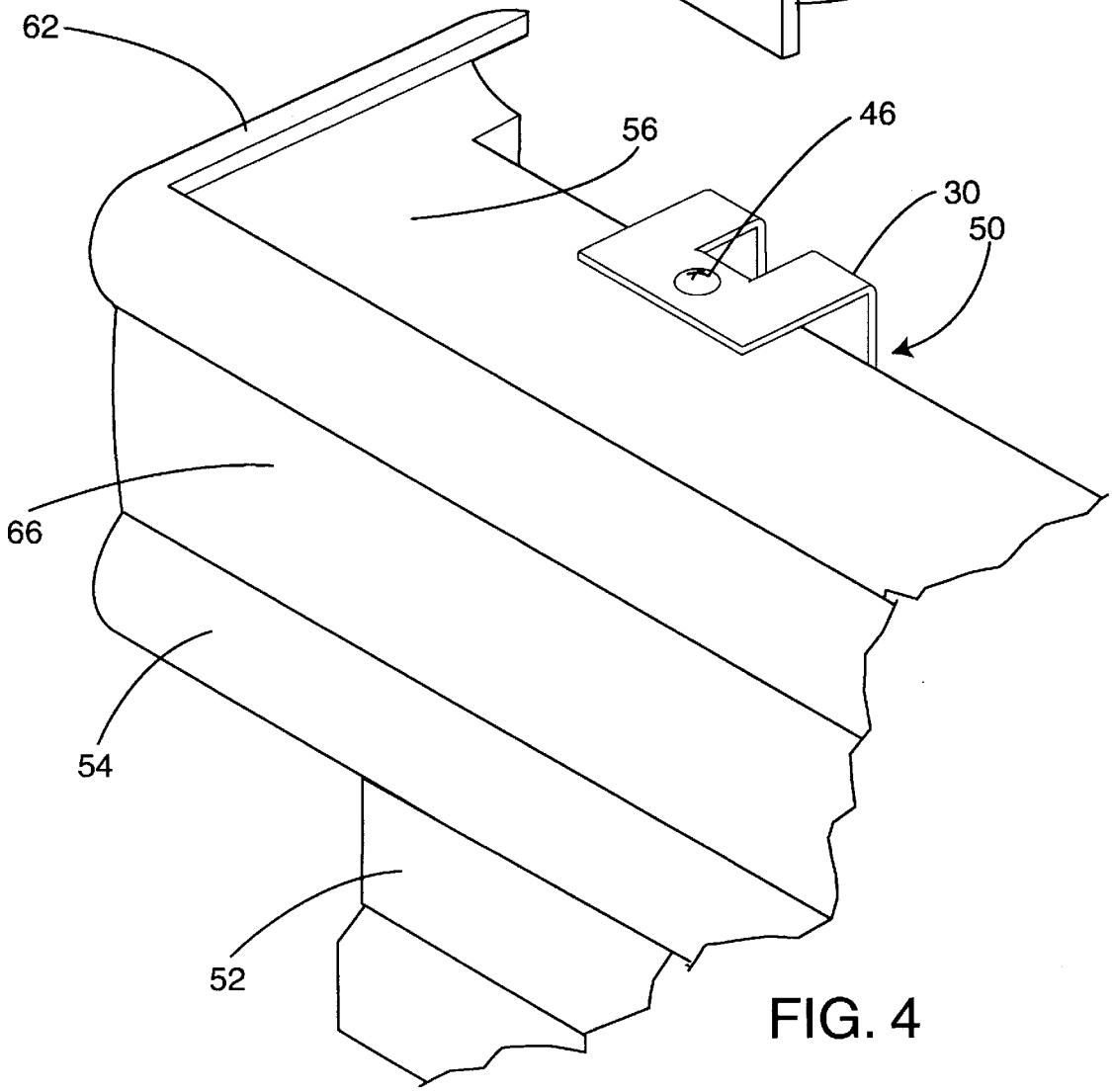
FIG. 4 is a fragmentary perspective view showing the attachment of the clip to the housing of the window covering.
Figure 5:
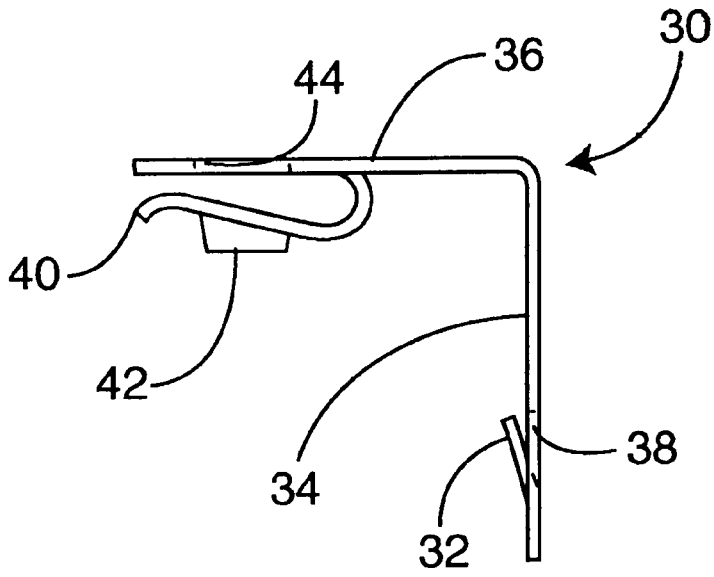
FIG. 5 is a side elevational view of the clip.
Figure 6:
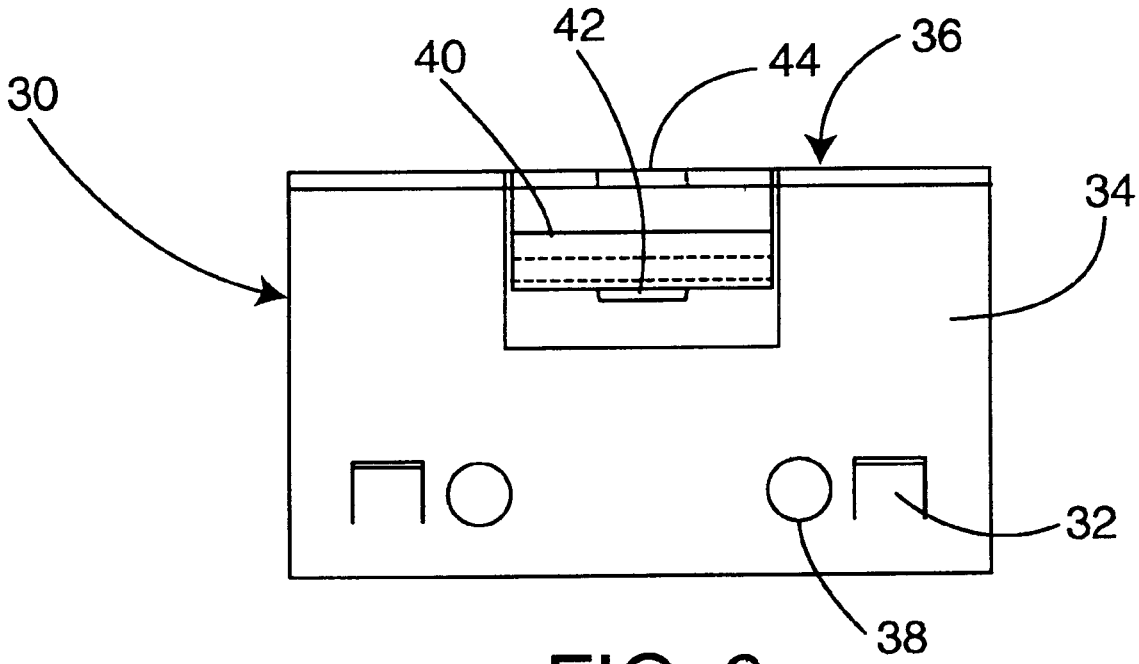
FIG. 6 is a front elevational view of the clip.

By way of disclosing a preferred embodiment and not by way of limitation, there is shown in FIG. 1 a roller shade assembly or window covering apparatus generally designated 50 comprising a housing 54, a roller shade or window covering 52, and a pair of clips 30. For purposes of disclosure, the present invention is described in connection with a conventional door 10 and a doorlight 12, including a frame 20. The clips 30 have a secured leg 34 secured between the door 10 and the frame 20 as more fully described below. The housing 54 of the window covering is attached to the clips 30 and fastened with a short screw 46.

Figure 7:
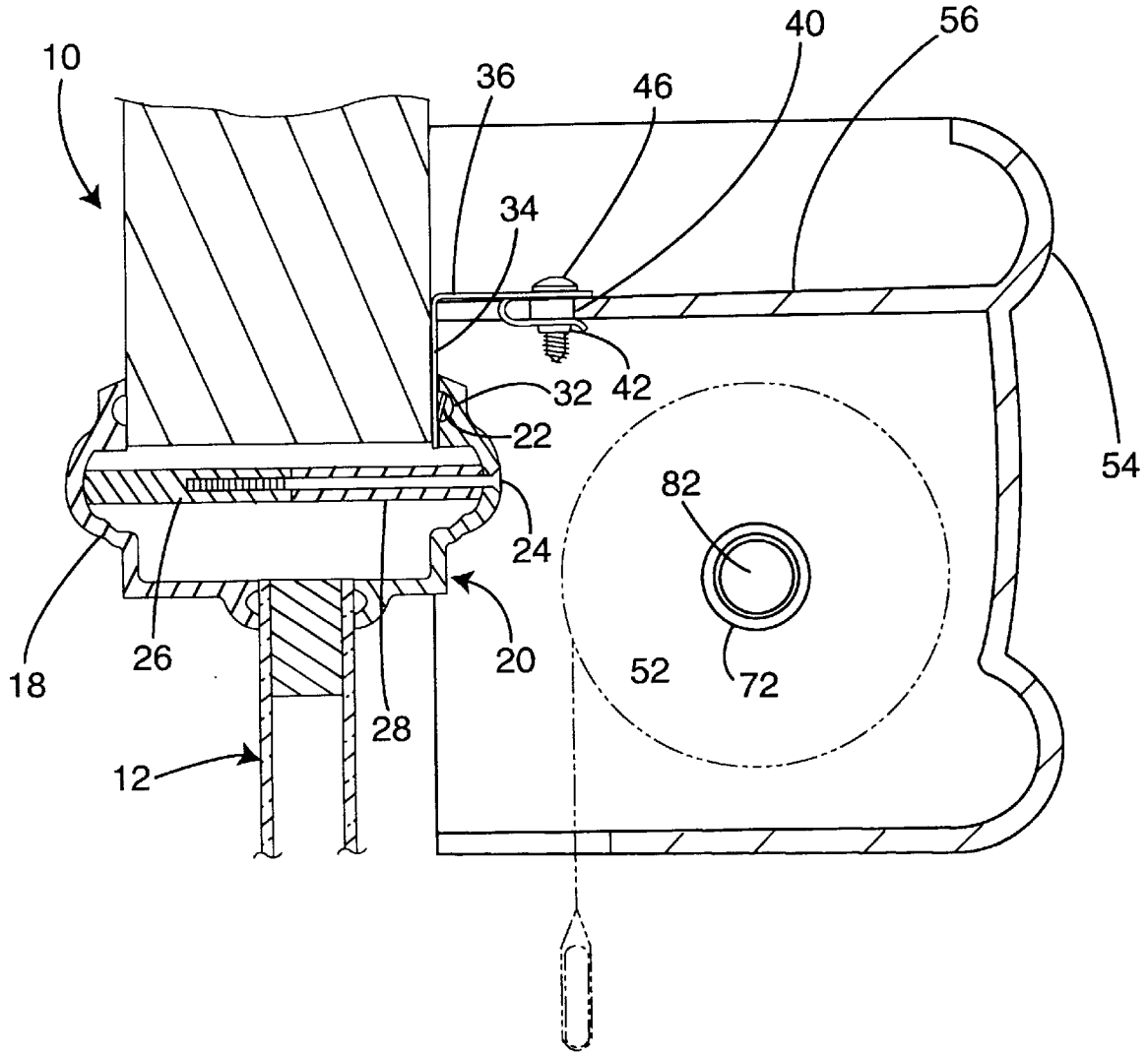
FIG. 7 is a left side cross-sectional view of the window covering assembly mounted on the door.
Figure 8:
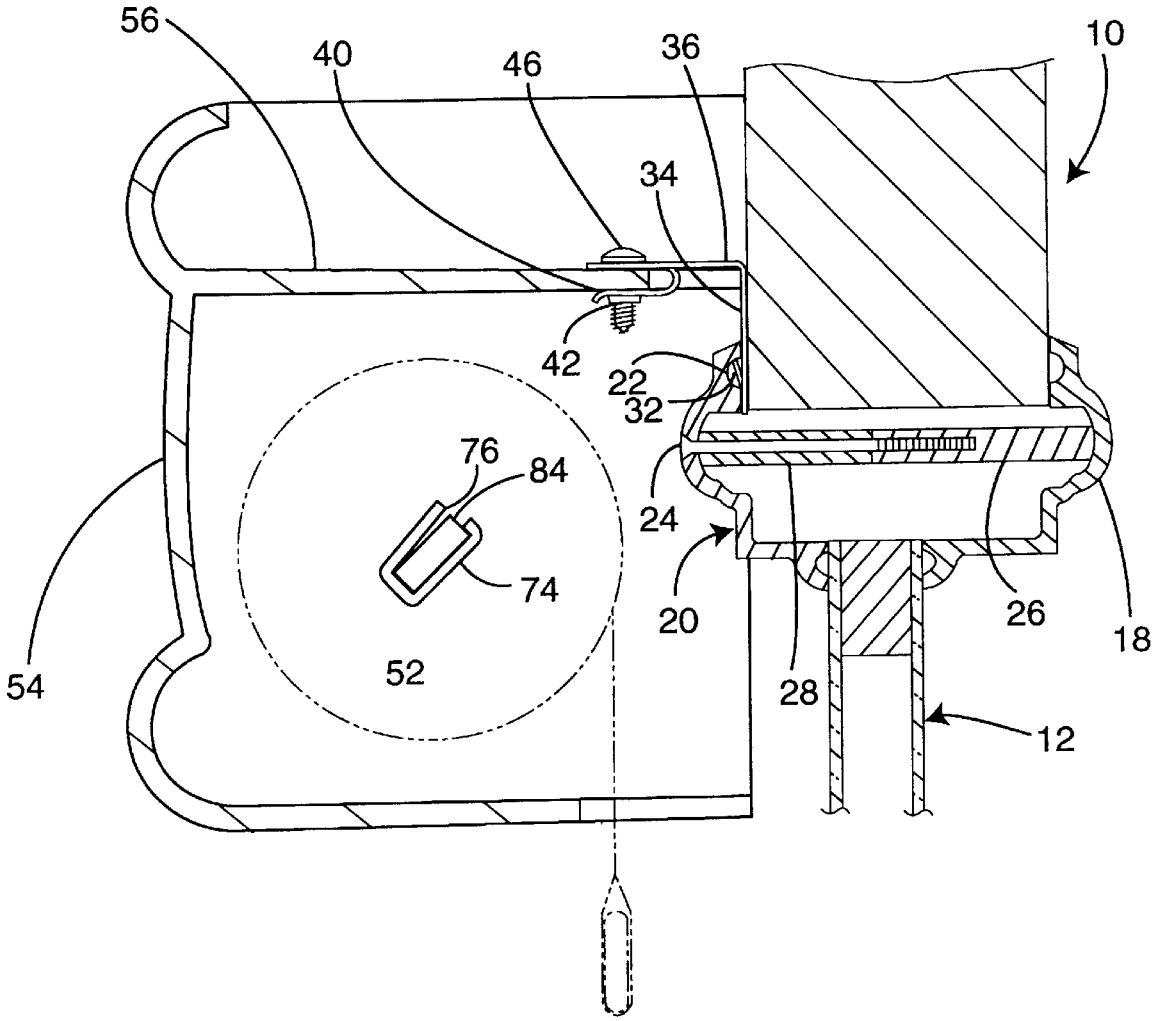
FIG. 8 is a right side cross-sectional view of the window covering assembly mounted on the door.

Details of the door 10 are shown in FIGS. 1, 2, 7 and 8. The door 10 has a doorlight 12 including a frame 20 as shown in FIG. 1. The frame 20 is attached to an identical frame 18 on the other side of the door by long frame screws 24. FIGS. 7 and 8 show a cross-sectional view with these long frame screws 24 exposed, the boss with through hole 28, and the boss with pilot hole 26 into which they are screwed. The frame 20 has an interior groove 22 facing the door 10 and running the entire perimeter of the frame 20.

As shown in FIGS. 3, 5, 7 and 8, the clips are generally L-shaped and include a secured leg 34 and a supporting leg 36. The secured leg 34 has protruding barbs 32 which fit within the interior groove 22 on the frame 20 when the roller shade is installed. The secured leg 34 also contains a pair of holes 38. The secured leg 34 is perpendicular to the supporting leg 36 of the clip. The supporting leg 36 includes an integral u-clip 40 which contains an integral threaded hole 42. The integral threaded hole 42 is aligned with a hole on the top of the u-clip 44 through which a short screw 46 passes in to the threaded hole 42. The u-clip 40 may be formed without an integral fastener 42, since any fastener in conjunction with a screw will work. The u-clip 40 and the protruding barbs 32 are punched out of the clip 30 during the manufacturing process.

The housing of the window covering 54 is made of molded plastic but can be made from other materials without departing from the spirit of the invention. The housing 54 has a right side 64 and a left side 62 which are injection molded while the front 66 is extruded. The housing 54 contains a top flange 56 slightly recessed below the top of the front 66 and sides 62, 64. The top flange 56 extends horizontally from the front of the housing 66 toward the door 10 with a small gap between the top flange 56 and the door 10.

The secured leg 34 of the clip 30 extends to the top flange 56 and the u-clip 40 on the supporting leg 36 interconnects with the top flange 56 supporting the housing 54 on the door 10. The clip 30 when connected to the housing 54 of the window covering apparatus 50 through the integral u-clip 40 and is doubly secured by a short screw 46. During installation, holes 58 are drilled in the top flange 56 to receive the short screws 46, which also pass through the top hole 44 within the u-clip 40 and the integral threaded hole 42. The housing 54 contains a rollershade 52 which is retained and mounted on integrally molded protrusions 72 and 74 as shown in FIGS. 7 and 8.

The roller shade 52contains a circular pin 82 and a non-circular pin 84 on the ends of the roller shade 52. The circular pin 82 fits within a matching circular integrally molded protrusion 72 on the housing 54. The non-circular pin 84, also interfits uniquely inside a matching integrally molded protrusion 74 on the housing 54. Venetian blinds, pleated shades, or any other form of coverings for windows may be substituted for a roller shade without departing from the spirit of the invention.

Assembly and Operation

The window covering apparatus 50 is shipped and sold as a unit including the window covering housing 54, a window covering 52, and the clips 30. To install the window covering apparatus 50, first the long frame screws 24 must be loosened on the top portion of the frame 20 which surrounds the doorlight 12. When there is a small gap between the upper portion of the frame 20 and the door 10, the clips 30 are placed behind the frame 20 with the secured leg 34 flat against the door 10 and the supporting leg 36 extending away from the door 10. The protruding barbs 32 fit within the interior groove 22 on the frame 20. The long frame screws 24 are then tightened, and the clips 30 become trapped between the frame 20 and the door 10. The protruding barbs 32 and the interior frame groove 22 hold the clips 30 in position while the long frame screws 24 are tightened. The protruding barbs 32 and the interior frame groove 22 position the clips 30 so the mounted window covering apparatus 50 is level. Once the clips 30 are in position behind the frame 20, the housing 54 is centered and the top flange 56 is pushed into the u-clip 40 on the supporting leg 36 of the clips 30. The small screw 46 is then inserted through the hole 44 on the u-clip, through the top flange 56 and screwed into the integral fastener 42. The clips 30 and the window covering housing 54 are now installed.

The last step in the assembly and installation of the window covering apparatus 50, if needed, is the installation of the roller shade 52. This assembly step may not be necessary for some forms of window coverings such as venetian blinds and pleated shades. The roller shade 52 is installed while rolled up, and the circular pin 82 is placed in the matching circular protrusion 72. The remaining noncircular pin 84 is placed in the matching noncircular protrusion 74 which can be accomplished by sliding the noncircular pin 84 through a slot 76 on the matching noncircular protrusion 74. The installation can also be accomplished without the slot 76 if one of the pins 82, 84 on the roller shade 52 contains a spring which is compressed while the roller shade 52 is installed.

The assembly shown in the figures is but illustrative of an unlimited variety of types, shapes, and configurations of assemblies which may be made according to the principles of the invention. The above description is that of a preferred embodiment of the invention. Various alterations and changes can be made without departing from the spirit and broader aspects of the invention as set forth in the appended claims which are to be interpreted in accordance with the principles of patent law including the doctrine of equivalents.

The embodiments of the present invention in which an exclusive property or privilege is claimed is defined as follows:

1. A door with a doorlight and a window covering, comprising:

a door defining an opening;

a doorlight mounted within said opening, said doorlight including a frame surrounding said doorlight;

a plurality of clips, each having a secured leg between said frame and said door, each clip further having a supporting leg extending from said door;

a window covering apparatus; and means for interconnecting said supporting leg and said window covering apparatus.

2. The door of claim 1, wherein said secured leg has protruding barbs for mounting said clips behind said frame, said frame having an interior groove facing said door where said barbs fit within said groove.

3. The door of claim 1, wherein said secured leg defines at least one hole for receiving a fastener on a door without said frame.

4. The door of claim 1, wherein said means for interconnecting said supporting leg and said window covering apparatus defines a hole, said means for interconnecting including a screw passing through said hole, said screw attached to a fastener.

5. The door of claim 1, wherein said supporting leg includes an integral u-clip, said u-clip capable of interconnecting said supporting leg and said window covering apparatus.

6. The door of claim 5, wherein said u-clip includes an integral fastener, said fastener containing a threaded portion for interconnecting with said screw.

7. The door of claim 1, wherein said window covering apparatus includes a means for supporting a window covering.

8. The door of claim 7, wherein said means for supporting said window covering is integrally molded in said window covering apparatus.

9. The door of claim 8, wherein said integrally molded means for supporting said window covering includes a cylindrical protrusion on said window covering apparatus.

10. The door of claim 8, wherein said integrally molded means for supporting said window covering includes a slotted protrusion on said window covering apparatus.

11. A window assembly having a window covering, comprising:

a support structure;

a window frame mounted within said support structure;

a plurality of clips, each having a secured leg between said window frame and said support structure, each clip further having a supporting leg extending from said secured leg;

a window covering apparatus; and means for interconnecting said supporting leg and said window covering apparatus.

12. The window assembly of claim 11, wherein:

said window frame defines an interior groove facing said support structure; and said secured leg includes at least one protruding barb fitted within said groove.

13. The window assembly of claim 11, wherein:

said secured leg defines at least one hole for receiving a fastener; and wherein said means for interconnecting further includes a fastener extending through said hole and into said support structure.

14. The window assembly of claim 11, wherein said means for interconnecting defines a hole, said means for interconnecting includes a screw passing through said hole, said screw attached to a fastener.

15. The window assembly of claim 14, wherein said supporting leg defines an integral u-clip, said u-clip includes an integral fastener for interconnecting said supporting leg and said window covering apparatus.

16. The window assembly of claim 11, wherein said window covering apparatus includes a means for supporting a window covering on said window covering apparatus.

17. The window assembly of claim 16, wherein said means for supporting said window covering is integrally molded in said window covering apparatus.

18. A clip for mounting a window covering apparatus between a window frame and a support structure, said clip comprising:

a clip having a secured leg and a supporting leg, said supporting leg extending generally perpendicularly from said secured leg;

said secured leg including at least one protruding barb for retaining said clip between the frame and the support structure;

said secured leg defining at least one hole for receiving a fastener therethrough; and said supporting leg including a means for receiving the window covering apparatus said means for receiving defining a U-clip defining a hole, said U-clip opening in a direction generally parallel to said supporting leg and away from said secured leg.

* * * * *